US005360669A

United States Patent [19]

Noland et al.

[11] Patent Number: 5,360,669

[45] Date of Patent: Nov. 1, 1994

[54] CARBON FIBERS

[75] Inventors: Robert L. Noland, Carson City, Nev.; Timothy D. O'Brien, Crofton, Md.

[73] Assignee: Ketema, Inc., Odenton, Md.

[21] Appl. No.: 534,075

[22] Filed: Jun. 6, 1990

Related U.S. Application Data

[63] Continuation-in-part of Ser. No. 476,050, Jan. 31, 1990.

[51] Int. Cl.[5] ..... B32B 9/00

[52] U.S. Cl. ..... 428/408; 428/113; 428/225

[58] Field of Search ..... 428/408, 225, 113

[56] References Cited

U.S. PATENT DOCUMENTS

| | | | |
|---|---|---|---|
| 3,174,895 | 3/1965 | Gibson | 161/159 |
| 3,422,171 | 1/1969 | Oppenlander | 264/51 |
| 3,580,731 | 5/1971 | Milewski et al. | 117/66 |
| 3,607,672 | 9/1971 | Schmitt | 23/209.1 |
| 3,745,104 | 7/1973 | Hou | 204/164 |
| 3,767,741 | 10/1973 | Toyoguchi | 264/29 |
| 3,841,079 | 10/1974 | Ram | 57/140 R |
| 3,925,524 | 12/1975 | Kimmel | 264/29 |
| 4,032,607 | 6/1977 | Schulz | 264/29.3 |
| 4,307,478 | 12/1981 | Ward | 15/159 A |
| 4,317,809 | 3/1982 | Lewis | 423/447.1 |
| 4,374,114 | 2/1983 | Kim | 423/447.1 |
| 4,402,928 | 9/1983 | Lewis | 423/447.1 |
| 4,699,896 | 10/1987 | Sing | 502/423 |
| 4,735,841 | 4/1988 | Sourdet | 428/408 |
| 4,746,470 | 5/1988 | Fujimaki | 264/29.2 |
| 4,753,762 | 6/1988 | Li | 264/54 |
| 4,816,338 | 3/1989 | Terasaki et al. | 428/408 X |
| 4,959,261 | 9/1990 | McCullough, Jr. et al. | 428/408 X |
| 5,015,522 | 5/1991 | McCullough, Jr. et al. | 428/408 X |

FOREIGN PATENT DOCUMENTS

| | | |
|---|---|---|
| 1926723 | 1/1989 | Japan . |
| 8908488 | 9/1989 | WIPO . |

OTHER PUBLICATIONS

Exploratory Experiments in the Conversion of Plasticized Melt Spun Pan-Based Precursors to Carbon Fibers. D. Grove et al, vol. 26, pp. 403–411, 1988.

Evolution of Structure and Properties in Continuous Carbon Fiber Formation. M. Balasubramanian et al, pp. 312–313.

Morphology and Oxidative Stabilization of Acrylic Precursor Fibers. J. Jain et al, pp. 310–311.

High-Temperature Deformations in Conversion of Acrylic Fibers to Carbon Fibers. M. Balasubramanian et al, pp. 497–498.

Morphological Rearrangements in Conversion of Acrylic Fibers to Carbon Fibers: Oxidative Stabilization. M. Jain et al, pp. 517–518.

Oxidative Stabilization of Oriented Acrylic Fibers—Morphological Rearrangements. M. Jain et al, Journal of Materials Science 18 (1983), pp. 179–188.

From Pan-Based Precursor Polymers to Carbon Fibers: Evolution of Structure and Properties. A. Abrihaman, Georgia Institute of Technology, pp. 945–952.

Conversion of Acrylonitrile-Based Precursors to Carbon Fibres (Part 3 Thermooxidative stabilization and continuous, low temperature carbonization). M Balasubramanian et al, Journal of Materials Science, 22 (1987) pp. 3864–3872.

Conversion of Acrylonitrile-Based Precursors to Carbon Fibres (Part 2 Precursor morphology and thermo-oxidative stabilization), M. Jain et al, Journal of Materials Science 22 (1987) pp. 301–312.

Conversion of Acrylonitrile-Based Precursors to Carbon Fibres (Part 1 A review of the physical and morphological aspects), M. Jain et al, Journal of Materials Science 22 (1987), pp. 278–300.

*Primary Examiner*—Peter A. Nelson

*Attorney, Agent, or Firm*—Sheridan Neimark

[57] ABSTRACT

Microcellular carbon filaments having a specific gravity about 20–30% less than conventional carbon fibers made of the same precursor resin are formed by foaming the precursor resin during spinning. These low density microcellular carbon filaments, which may also be hollow, have improved insulation properties compared with conventional carbon fibers, they have a higher than expected strength to weight ratio and adhere in a superior fashion to a variety of matrix materials.

9 Claims, 1 Drawing Sheet

$T_F$ = FOAM FIBER $T_e$ = CONVENTIONAL FIBER

CARBON FIBERS

RELATED APPLICATION

This is a continuation-in-part of co-pending application Ser. No. 07/476,050 filed Jan. 31, 1990, the contents of which are incorporated herein by reference.

FIELD OF INVENTION

The present invention relates to improved carbon fibers having a microcellular structure, and products using such microcellular carbon fibers.

BACKGROUND

Co-pending application Ser. No. 07/476,050 relates to improved microcellular carbon fibers based on polyacrylonitrile (PAN) and structures formed of such mircocellular carbon fibers from PAN precursor fibers, these being used as a replacement for carbon fibers made from high purity viscose rayon and especially for use in the space industry.

However, carbon fibers are used in many environments in addition to the space industry as disclosed in parent application Ser. No. 07/476,050, and carbon fibers of this type are made from various precursor materials including pitch. In general, carbon fibers are used in what may be broken down into three general categories, namely in thermal insulators, in structural applications, and in miscellaneous environments.

Thus, conventional carbon fibers are used in thermal insulation environments to replace asbestos for many purposes, such as furnace insulation, brakes including aircraft, automotive, truck, and off-road vehicle brakes, passive fire protection, etc. In brakes, carbon fibers are used in a carbon matrix to provide a carbon-carbon structure.

Concerning carbon-carbon materials, the Kirk-Othmer Encyclopedia of Chemical Technology (3rd Ed. 1980), Vol. 12, page 463 states:

> Carbon represents the ultimate high temperature end-member of polymer matrix materials. It has one of the highest temperature capabilities under non-oxidizing conditions among known materials (it melts or sublimes, depending on the pressure, at 3550° C.). Additional considerations of chemical and thermal compatibility make it natural to use carbon and graphite fibers as the reinforcement material. The resultant carbon-carbon . . . composites . . . are especially desirable where extreme temperatures may be encountered, such as in rocket nozzle, ablative materials for re-entry vehicles and disk brakes for aircraft. Other uses include bearing materials . . . and hot-press die components.

The specific gravity of carbon fibers depends on a number of factors including the nature of the precursor material and the degree of crystallinity (if any) in the resultant carbon fiber. Thus, well-ordered graphite molecular structure is dense. Novoloid precursor based carbon fibers are amorphous and have a relatively low specific gravity, whereas carbon fibers based on PAN are much denser having a normal specific gravity ($g/cm^3$) of 1.8–2.0. The Kirk-Othmer Encyclopedia of Chemical Technology (3rd Ed. 1981), Vol. 16, page 135 contains a table (Table 3) showing typical properties of carbon fibers.

This table is reproduced below:

TABLE 3

Typical Properties of Carbon Fibers

| Property | Precursor: Novoloid | | Pitch | | Polyacrylonitrile | |
|---|---|---|---|---|---|---|
| type | low modulus | | low modulus | | high modulus | |
| treatment temperature, °C. | 800 | 2000 | 1000 | 2000 | 1500 | 2000 |
| specific gravity, $g/cm^3$ | 1.55 | 1.37 | 1.63 | 1.55 | 1.8–1.9 | 1.9–2.0 |
| carbon content, wt % | 95 | 99.8+ | 95 | 99.5+ | 93 | 99.5+ |
| x-ray diffraction profile, 002,20 degrees | 23.0[a] | 25.0[a] | 24.0[a] | | 25.0[b] | 26.1[c] |
| interlayer spacing, $d_{002}$, pm | 395 | 351 | | | | 336 |
| tensile strength, MPa[d] | 500–700 | 400–600 | 500–1000 | | 1500–3000 | |
| elongation, % | 2.0–3.0 | 1.5–2.5 | 1.5–2.5 | | 1.0–1.5 | |
| modulus, GPa[e] | 20–30 | 15–20 | 30–50 | | 150–300 | |
| heat resistance, °C. | | | | | | |
| tga | 436 | 541 | 416 | | 519 | |
| air | 350 | 380 | 350 | | 350 | |
| specific resistivity, mΩ-cm | 10–30 | 5–10 | 10–30 | | 1–10 | |
| affinity with PTFE, CPE, epoxides[f] | good | | fair | | poor | |

[a]Broad.
[b]Medium.
[c]Sharp.
[d]To convert MPa to psi, multiply by 145.
[e]To convert GPa to psi, multiply by 145,000.
[f]PTFE = polytetrafluoroethylene; CPE = chlorinated polyethylene.

The text on page 135 states:

> The decrease in specific gravity of Novoloid-based carbon as temperature exceeds 1000° C. is remarkable and has not been adequately explained. It does not appear related to any observable development of microporosity or voids.

The most commonly used PAN based carbon filaments have a specific gravity of 1.75 (e.g. Hercules AS-4), whereas the most commonly used pitch based carbon filaments, mesophase pitch based, have a specific gravity of 1.85 to 2.10.

In structural applications, there is an important relationship between the weight of the fiber and its strength. Carbon fibers are often used in place of glass fibers as reinforcement in order to save weight, for example in aircraft and space structure where weight is critical. In aircraft, carbon fiber is used for reinforcement of secondary structures and interior parts such as flooring, luggage bins, ducting, etc. While conventional carbon fibers are very useful in the environments noted above and have an excellent strength to weight ratio, the need exists for fibrous reinforcing materials having an even better strength to weight ratio.

Carbon fibers are also used in a variety of miscellaneous environments such as for high temperature gaskets, seals, pump packing, medical implants, cement reinforcement, etc. Most fiber-reinforced plastics are laminated materials. The fibers in each layer are usually arranged in one of four configurations such as in the form of uni-directional tape, woven fabric, chopped and aligned fibers or randomly disposed fibers in the form of a mat or non-woven fabric.

As pointed out above, two important factors in any use are strength and weight. Another important property is the compatibility of the carbon fibers to the matrix material, e.g. how well the matrix material adheres to and holds the carbon fiber reinforcing material in place. Carbon fibers do not always adhere as well as desirable to the selected matrix material. Conventional carbon fibers especially do not adhere well to thermoplastic resins. Thus, the Kirk-Othmer Encyclopedia of Chemical Technology, (3rd Ed., 1984) Supplement Volume states:

> Thermoplastic matrix materials are expected to assume a major role in fiber-reinforced plastics in the next few years. Thermoplastics have the potential for reduced fabrication costs, improved repairability, damage tolerance, and chemical resistance. However, development of an inexpensive thermoplastic that adheres well to carbon fibers and has satisfactory resistance to solvent has not yet to be achieved.

Accordingly, improvements in these areas would be desirable.

SUMMARY OF THE INVENTION

It is, accordingly, an object of the present invention to overcome deficiencies of the prior art, such as those indicated above.

It is another object of the present invention to provide carbon filaments from a variety of sources including pitch, which carbon filaments have improved insulation properties.

It is a further object of the present invention to provide microcellular carbon filaments having a specific gravity on the order of about 20–30% less than prior carbon filaments from the same precursor, starting with mircocellular filaments formed from pitch or the like.

It is still another object of the present invention to provide carbon filaments which are both hollow and cellular, formed from pitch-type filaments which are hollow and microcellular.

It is still a further object of the present invention to provide woven carbon fiber fabrics, which carbon fibers are microcellular and have a specific gravity of at most about 20–30% less than prior carbon fibers from the same precursor.

It is yet a further object of the present invention to provide a variety of products such as insulation, brakes, passive fire protection panels, structural elements, gaskets, seals, pump packings, medical implants, cement reinforcement elements, etc. from microcellular carbon fibers derived from pitch or the like, which products are substantially equal to or better with regard to their strength to weight ratio and which have improved anchoring in their matrices compared to otherwise similar parts made from conventional carbon fiber derived from the same precursor.

It is yet another object of the present invention to provide microcellular carbon fibers having a rough surface for improved anchoring in matrix material and which have an excellent strength to weight ratio.

These and other objects of the present invention will be more apparent from the following detailed description. In brief, however, the present invention involves the use of microcellular monofilaments formed of pitch or other bituminous material or the like or from any one of a variety of resins or polymers for the manufacture of microcellular carbon fibers as a replacement for the carbon fibers presently in use. The microcellular carbon fibers so produced have excellent insulative properties, a high strength to weight ratio and a pocked surface which improves their adherence to various matrix resins. These mircocellular carbon fibers have a specific gravity of at most about 25–50% less than the conventional carbon fibers derived from same precursor material, and may also be produced with a hollow core which further reduces their specific gravity and increases their insulative properties and strength to weight ratio. Additional aspects of the invention will become more apparent from the following detailed description, taken in conjunction with the drawing, wherein:

DETAILED DESCRIPTION OF EMBODIMENTS

Figure 2:
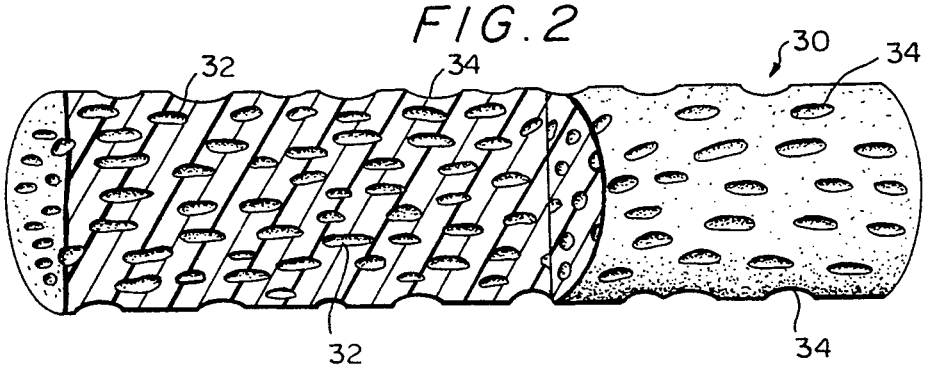
FIG. 2 is a schematic illustration of both a resinous microcellular precursor filament and the microcellular carbon filament made therefrom, on a greatly enlarged scale.
Figure 3:
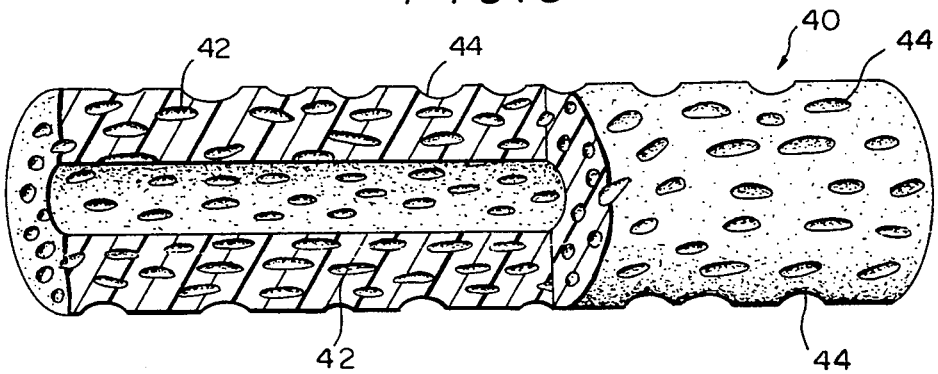
FIG. 3 is a greatly enlarged schematic view similar to that of FIG. 2 of an alternate embodiment wherein the filament is both hollow and microcellular.

FIGS. 2 and 3 provide schematic representations of two embodiments of precursor fibers, such as those made from pitch, and the resultant carbon fibers formed therefrom in accordance with the present invention. The fiber or filament 30 of FIG. 2 is provided with generally elongated internal cells 32. In addition, partial cells 34 form on the exterior surface so as to provide a pock-marked surface, i.e. a series of depressions or cavities. Whether these microcellular carbon filaments 30 are woven into fabric or are used in non-woven mat or other form, they are used as insulation material by impregnation thereof with a suitable matrix resin, such as phenolic resin, epoxy resin, urea or melamine resin, silicone rubber, polyester resin, polyimine, polybutadiene, vinyl ester polymers, and thermoplastics including polyetherketone (PEEK), polyetherimide (PEI) and polysulfone, to form any particular product; it is found that exceptional bonding occurs between the resin and the fibers 30 because of the depressions 34 provided in the surface of the fibers. Improved insulation also occurs because of the internal cells 32.

The filament 40 of FIG. 3 is similar to the filament 30 of FIG. 2, having internal cells 42 and external depressions 44, but differs in that the microcellular filament 40 is hollow, same having a bore extending axially therethrough. Because of the hollow bore extending therethrough, the specific gravity of the fiber 40 is quite low, same being on the order of less than 1.35, preferably about 1.0–1.2, and the insulating ability being even greater than that of the microcellular carbon fiber 30 if FIG. 2. The microcellular carbon fiber 40 of FIG. 3 is not as strong as the microcellular filament 30 of FIG. 2, but has an even higher strength to weight ratio. On the other hand, it is somewhat more difficult to manufacture, and so is somewhat more costly on a weight basis.

In both cases the filaments 30 and 40 desirably have a fiber diameter on the order of about 5–15 micrometers, usually 6–10 micrometers, as is conventional. It will be understood that exterior cross-sections other than circular can be formed, e.g. tri- or tetra-lobal. Also, more than one longitudinal bore can be provided for the hollow microcellular carbon fiber 40 of FIG. 3, e.g. it can be tri- or tetra-ocular.

Suitable precursors include mesophase (liquid crystal) pitch, ordinary (non-mesophase) pitch, polyacetylene, poly (vinyl alcohol), polybenzimidazole, furan resins (mixed with or reacted with phenolic resins or pitch), and novoloids (e.g. phenolic resin). These materials are initially thermoplastic and then go through a thermoset phase.

Microcellular fibers 30 as shown in FIG. 2 have a reduction in specific gravity of about 20–30% compared to a conventional carbon fiber formed from the same precursor material. Therefore, such microcellular carbon fibers formed from Novoloid precursor treated at 800° C. will have a specific gravity of about 1.09–1.25, as well as such microcellular carbon fibers derived from pitch treated at 2000° C. Microcellular carbon fibers according to the present invention derived from Novoloid treated at 2000° C. will have a specific gravity of about 0.96–1.1, whereas such microcellular carbon fibers derived from pitch treated at 1000° C. will have a specific gravity of about 1.15–1.3.

The hollow microcellular carbon fibers 40 of FIG. 3 have an even greater reduction in specific gravity, these ranging from as much as 50% to as little as about 25%. Thus, for hollow microcellular carbon fibers derived from Novoloid treated at 800° C. or pitch treated at 2000° C., the specific gravity may range from about 0.78 to about 1.2. For hollow microcellular carbon fibers derived from Novoloid treated at 2000° C., the specific gravity may range from as low as 0.7 to as great as 1.1. The specific gravity of hollow microcellular carbon fibers derived from pitch treated at 1000° C. can range from about 0.8 to about 1.3.

The microcellular carbon fibers of the present invention are made by the use of a blowing agent during the spinning of the precursor polymer, and the resultant microcellular precursor fibers are then treated to form the microcellular carbon fibers according to the conventional manufacturing processes for converting that particular precursor material into carbon. Thus, the precursor is for example melt spun in its thermoplastic state using a blowing agent, and the spun yarn is then thermoset to render the microcellular polymer fibers infusible and capable of being carbonized. A suitable process is illustrated below starting with mesophase pitch as the precursor material.

The mesophase pitch together with a suitable blowing agent and, if desired, a solvent or plasticizer or other additive to lower its melting point, are mixed such as in a screw extruder and then forced through a monofilament or multifilament die at a temperature sufficiently high to release the blowing agent in gaseous form and at least to the softening temperature of the mesophase pitch composition. The resultant foamed mesophase pitch is stretched, quenched and oriented, and the resultant spun yarn is then thermoset in an oxidizing atmosphere to render the yarn infusible. The oriented infusible yarn is then carbonized and, if desired, graphitized according to conventional technology.

Suitable blowing agents may be selected from those well known in the art, and which are compatible with the particular precursor material in question, e.g. mesophase pitch. In this regard, blowing agents are disclosed in Li et al U.S. Pat. No. 4,753,762 and Oppenlander U.S. Pat. No. 3,422,171, the disclosures of which are incorporated by reference, both showing methods for producing foamed polymer filaments. Other blowing agents are also known, including injected gas such as nitrogen and carbon dioxide. It will be understood that where a blowing agent other than injected gas is used, the temperature and pressure relationship must be such that upon extrusion, i.e. spinning, the blowing agent will release gas to effect the necessary blowing. One suitable composition for melt spinning through a 0.11 mm die orifice is a mixture of mesophase pitch and 0.25% Hoechst Hostatron P9947 blowing agent.

Details concerning extrusion temperature and various post-treatments are available from the literature including the patent literature, and some of the patents which may be consulted include Lewis et al U.S. Pat. Nos. 4,402,928; Lewis et al 4,317,809; Toyoguchi et al 3,767,741; and Fujimaki et al 4,746,470.

The microcellular carbon fibers 30 and 40 produced according to the present invention have a somewhat lower strength than conventional carbon fibers formed of the same precursor material, but they are nevertheless found to have a surprisingly high strength to weight ratio; in other words, their strength is reduced to a lesser degree than is their specific gravity. In addition, the microcellular carbon fibers 30 and 40 have exceptional insulating properties and adhere much better to matrix materials than do the conventional carbon fibers.

The microcellular carbon fibers of the present invention are useful in a wide variety of environments, and can be used as a replacement for asbestos and conventional carbon fibers in many applications including furnace insulation, brakes (aircraft, auto, trucks, off-road), passive fire protection, and other thermal insulator environments. Because of its lower thermal conductivity, the microcellular carbon fiber of the present invention is advantageous compared to the conventional fibers for most of these uses. For example, for use as furnace insulation comparable heat transfer results are obtained with less insulation thickness when the microcellular fiber of the present invention is employed compared with conventional carbon fiber.

Figure 1:
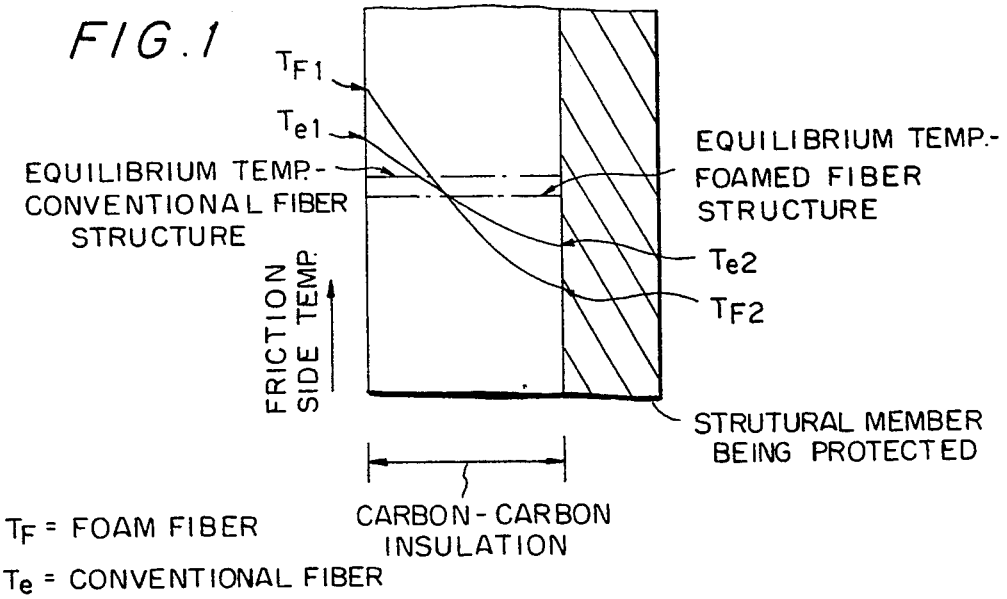
FIG. 1 is a graph illustrating the improved heat insulative properties of carbon—carbon insulation formed using microcellular carbon fibers according to the present invention compared with similar carbon—carbon insulation using conventional carbon fiber.

In the construction of aircraft brakes using a carbon-carbon structure employing carbon reinforcing fibers and a carbon matrix, the performance of the brakes when using microcellular carbon fiber according to the present invention as compared with conventional carbon fiber is shown in FIG. 1 which schematically illustrate the thermal profile through the carbon-carbon insulation at the end of the brake action.

The maximum temperature that the structural member is exposed to is the equilibrium temperature that occurs some period of time after the breaking action has ceased, it being understood that the temperature profiles are based on transient transmission of the frictional heat that is generated as shown by the graph of FIG. 1, the equilibrium temperature using microcellular carbon fibers is lower than that using conventional carbon fiber for the same thickness of insulation.

Consequently, to obtain the same equilibrium temperature value, the brake pads can be made correspondingly thinner which provides a first saving in weight. Because the microcellular carbon fibers of the present invention are lighter in weight than conventional carbon fibers, this provides a second savings in weight, so that the total savings in weight is significant.

Microcellular carbon fibers according to the present invention are also useful for structural applications, especially for aircraft and space structures where weight is critical. Although the strength of any particular microcellular carbon fiber is lower than the strength of a conventional carbon fiber of equal diameter, the strength to weight ratio is higher. In many commercial aircraft applications where strength is not a major factor such as luggage bins, ducting, etc. carbon fiber is used in place of glass fiber in order to save weight. Use of the microcellular carbon fiber of the present invention provides an added increase in weight reduction.

Carbon fiber is also used in a variety of environments such as high temperature gaskets, seals, pump packing, medical implants, cement reinforcement, etc. in place of asbestos and other reinforcing materials. The microcellular carbon fibers of the present invention are very useful in these miscellaneous environments and provide excellent adhesion to a wide variety of matrix materials.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An improved carbon fiber formed from a foamed resinous material and having a microcellular structure and a specific gravity approximately 20–30% less than a carbon fiber formed of the same precursor material and treated in the same way but not foamed.

2. A carbon fiber according to claim 1 having a pockmarked outer surface.

3. A carbon fiber according to claim 1 having a hollow bore extending therethrough.

4. A carbon fiber according to claim 2 having a hollow bore extending therethrough.

5. A carbon fiber according to claim 1 wherein said precursor material is pitch.

6. A carbon fiber according to claim 5 wherein said pitch is mesophase pitch.

7. A carbon fiber according to claim 5 having a specific gravity of about 1.1 to 1.3.

8. A carbon fiber according to claim 3 formed of pitch and having specific gravity of about 0.78 to 1.2.

9. In a composite material formed of a matrix material reinforced with carbon fibers, the improvement wherein said carbon fibers are formed from a foamed resinous material and have a microcellular structure and a specific gravity approximately 20–30% less than a carbon fiber formed of the same precursor material and treated in the same way but not foamed.

* * * * *